US006537235B1

(12) United States Patent
Connor et al.

(10) Patent No.: US 6,537,235 B1
(45) Date of Patent: Mar. 25, 2003

(54) SCARF WITH ELECTRICALLY OPERATED MASSAGER

(76) Inventors: Clara Connor, 9459 Hollyhock Ave., Fountain Valley, CA (US) 92708; Ernest J. Busto, P.O. Box 2578, Cypress, CA (US) 90630

( * ) Notice: Subject to any disclaimer, the term of this patent is extended or adjusted under 35 U.S.C. 154(b) by 0 days.

(21) Appl. No.: 09/962,816

(22) Filed: Sep. 25, 2001

(51) Int. Cl.[7] ..... A61H 1/00; A42B 5/00
(52) U.S. Cl. ..... 601/70; 2/207
(58) Field of Search ..... 601/24, 49, 57, 601/46, 56, 58, 93, 59, 60, 67, 68, 69, 70, 71, 73, 74, 79; 607/109; 2/207

(56) References Cited

U.S. PATENT DOCUMENTS

| | | | | | |
|---|---|---|---|---|---|
| 4,109,321 | A | * | 8/1978 | Shapiro | 2/91 |
| 4,805,619 | A | | 2/1989 | Swearingen | |
| 4,878,489 | A | * | 11/1989 | Kamayachi | 601/72 |
| 5,016,629 | A | | 5/1991 | Kanare | |
| 5,086,629 | A | * | 2/1992 | Dibrell | 401/6 |
| 5,088,549 | A | * | 2/1992 | Schneider | 165/46 |
| D337,826 | S | | 7/1993 | Iverson | |
| 5,344,437 | A | * | 9/1994 | Pistay | 5/639 |
| 5,393,297 | A | * | 2/1995 | Kristoff | 4/523 |
| D364,229 | S | | 11/1995 | Connor | |
| 5,605,144 | A | | 2/1997 | Simmons et al. | |
| 5,807,287 | A | * | 9/1998 | Cheng | 601/49 |
| D408,542 | S | | 4/1999 | Hoover, Jr. | |
| 5,902,256 | A | * | 5/1999 | Benaron | 601/108 |
| 5,913,838 | A | * | 6/1999 | Reilly | 36/136 |
| D418,606 | S | | 1/2000 | Davis et al. | |
| D425,992 | S | | 5/2000 | Davis et al. | |
| 6,142,963 | A | * | 11/2000 | Black et al. | 601/56 |
| 6,203,470 | B1 | * | 3/2001 | Lundin et al. | 482/10 |

* cited by examiner

*Primary Examiner*—Nicholas D. Lucchesi
*Assistant Examiner*—Fenn C Mathew
(74) *Attorney, Agent, or Firm*—James G. O'Neill

(57) ABSTRACT

A combination massager and scarf assembly having a number of electrical motors secured in a flexible casing, which flexible casing is removably secured in the interior of the scarf. The scarf is wrapped around the flexible casing and the motors in the casing are electrically connected to a control box having an A.C. or D.C. power supply to actuate the electrical motors. The control box includes a knob to regulate the speed of vibration of the motors.

14 Claims, 2 Drawing Sheets

SCARF WITH ELECTRICALLY OPERATED MASSAGER

BACKGROUND OF THE INVENTION

1. Field of the Invention

This invention generally relates to massagers, and more particularly, to a combination scarf and massager to be worn by a user during usage of the massager.

2. Description of Related Art

Massagers come in many forms and types, such as those that are hand held or worn by a person. Many of the known massagers are held by the user, turned on and applied to the area or areas to be massaged.

Additionally, various types of massagers have been proposed that can be worn by a person during usage. Examples of such massagers are shown in U.S. Des. Pat. Nos. 337,826 and 364,229.

Furthermore, many types of body heating and cooling devices that may be applied to or worn by a user around a body part, such as the neck are known.

However, other than U.S. Design Pat. No. 364,229 ("'229"), none of the known devices disclose a combination scarf and massager. Furthermore, neither the '229 patent nor any other known patent discloses the structure of the present invention, which is simple in design, effective in use, and which can be directly applied to and held in place on any area of the body needing a massage, by a scarf.

SUMMARY OF THE INVENTION

It is, therefore, a general object of the present invention to provide a new and improved massager. It is a more particular object of the present invention to provide an electrically operated massager held in a scarf. It is yet another particular object of the present invention to provide a combination electrically operated massager and scarf for wearing by a person. It is yet a further particular object of the present invention to provide a more efficient electrically operated massager held in a scarf. It is a still further particular object of the present invention to provide an electrically operated massager held in a specifically formed pocket in a scarf. It is a further particular object of the present invention to provide an electrically operated massager held in a flexible pouch removably held in a scarf. It is still a further particular object of the present invention to provide an electrically operated massager held in a scarf and operated by an actuating system powered by A.C. or D.C. It is yet a still further particular object of the present invention to provide an electrically operated massager having an operating means for adjustably controlling the speed of the massager and capable of being held in a pocket formed in a scarf in which the massager is removably held.

In accordance with one embodiment of the present invention there is provided an electrically operated massager assembly secured in a flexible pouch, which pouch is removably held in a scarf. The massager is operated by a controller having a rotatable knob and is selectively powered by batteries, an automobile power system or an A.C. outlet.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved electrically operated massager held in a scarf, generally indicated at 10.

Figure 1:
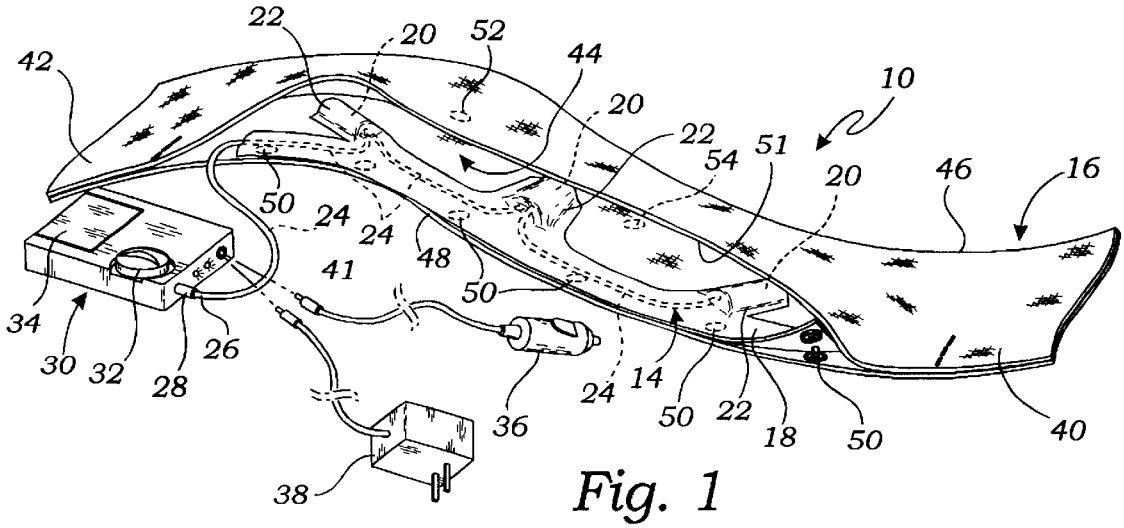
FIG. 1 is a perspective view of a preferred embodiment of the combination massager and scarf of the present invention.
Figure 2:
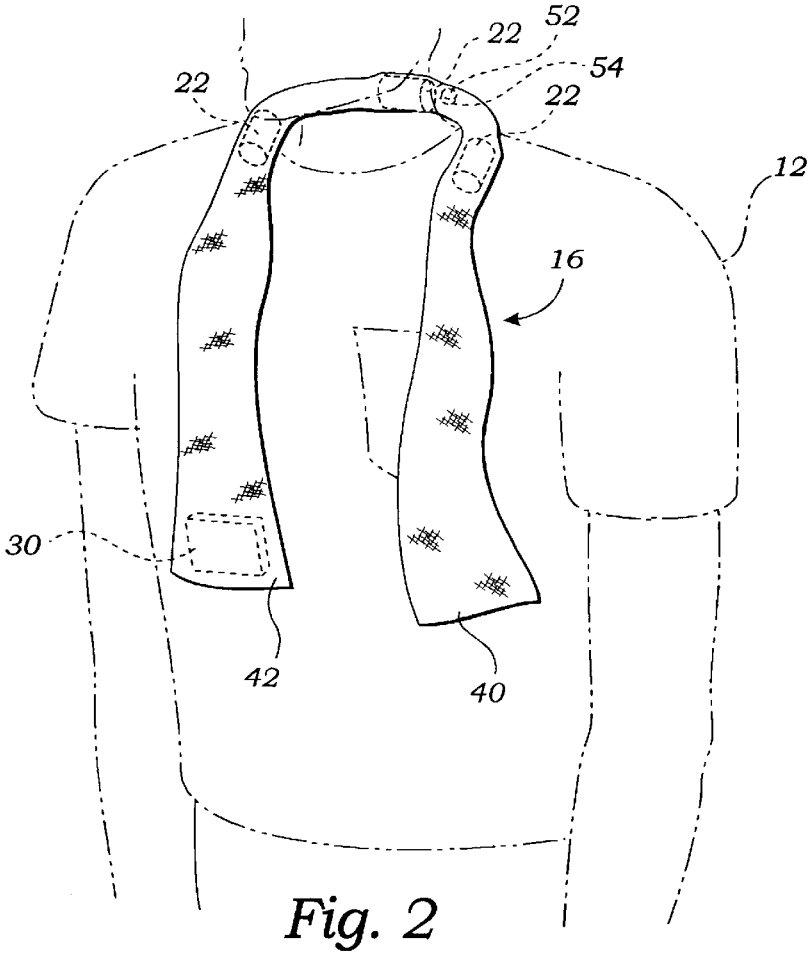
FIG. 2 is a perspective view of the massager and scarf of the present invention draped around the neck and shoulders of a user.

Referring now to the drawings, FIG. 1 is a perspective view of the combination massager and scarf 10 in a partially open position, while FIG. 2 shows the combination massager and scarf in the closed position and worn around the neck and shoulders of a user 12.

The combination electrically operated massager and scarf 10 of the present invention includes a massager assembly 14 and an elongated scarf 16. The massager assembly 14 includes an outer casing, container or pouch 18, preferably specifically formed or made from a flexible material, such as cloth or plastic, and a plurality of electrical motors 20. The motors 20 are sized and dimensioned to fit in pockets or formed portions 22 of the casing 18 and to be as flat as possible, while delivering sufficient power during vibration to provide a comfortable massage when placed against a person's body and activated, as described more fully below.

The plurality of electrical motors 20, three of which are shown in the drawings, may be connected together in any manner, but are preferably electrically connected together in series by wiring 24 inside of the casing 18. An outer end 26 of the wiring extends from the scarf 16 and includes a connector or probe 28 for insertion into a jack or opening 60 in a controller 30. The controller 30 includes a rotatable knob 32 on a top surface thereof, to regulate the power to and, therefore, the speed of vibration of the motors 20. The controller 30 is powered by one or more D.C. batteries 58 placed in the controller 30 through a cover 34, or via direct current from a unit 36 plugged into a vehicle, or A.C. from a plug 38 plugged into an outlet in a domestic power supply. The unit 36 and the plug 38 are selectively inserted into a jack or opening 41 in the controller 30.

The scarf 16 is preferably formed from one or two pieces of material, such as from a soft cloth, which is folded over and sewn, or otherwise secured together so as to form end pockets 40, 42 having an open internal pocket or portion 44 therebetween, and a closed side 46. The opening or pocket 44 is at least large enough to insert the casing 18 carrying the motors 20 therein. The casing 18 and motors 20 are preferably removably secured in the interior pocket 44 of the scarf 16, to a side edge 48 of the opening, by a plurality of holding or securing elements 50, such as snaps or the like, having mating portions secured to the scarf 16 and casing 18. The opposite or other side edge 51 of the opening 44 also preferably includes at least one holding element 52, at least toward the center of the opening 44. This at least one holding element 52 is held by or secured to a further holding element 54 on the outside surface of the scarf 16, below the casing 18, to enable the scarf 16 to be wrapped around the casing 18 to hide the massager in the scarf 10 when draped or wrapped around a user 12, for example, on the neck and shoulders thereof, as shown in FIG. 2.

As best shown in FIG. 2, the controller 30 fits within one of the pockets, such as 42 of the scarf 16 for convenient carrying of the same, either during a massage, i.e., with the controller activated by knob 32, or for storage when the scarf is worn for decoration or warmth, or taken off.

Figure 3:
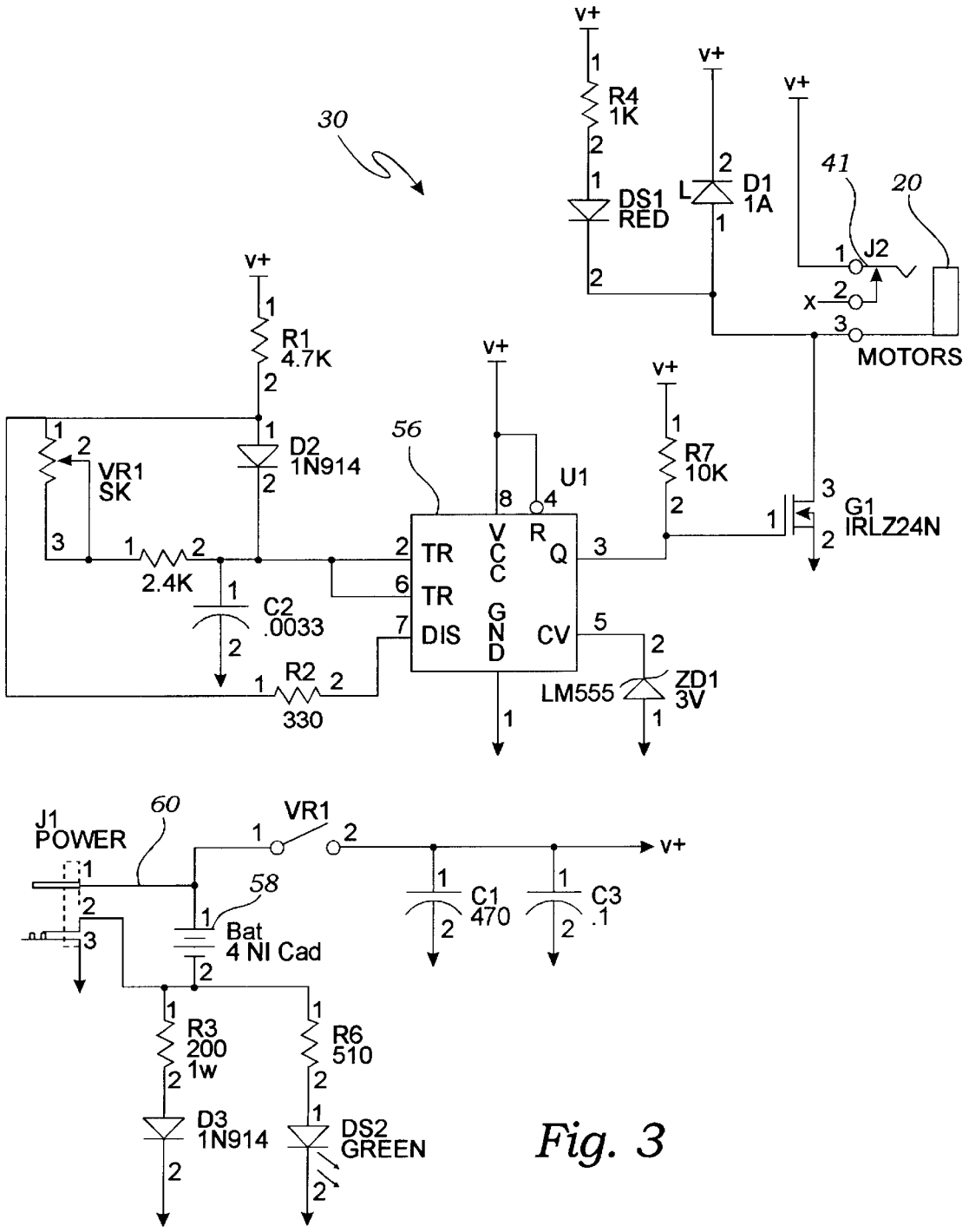
FIG. 3 is a schematic diagram of the preferred circuitry of the switch/regulator for the massager of the present invention.

Turning now to FIG. 3, there shown is a schematic diagram of a currently preferred embodiment of the controller 30 of the present invention. This controller 30 is a switch/regulator and includes a microprocessor 56 to control or regulate the power from batteries 58, the unit 36 or plug 38 to efficiently start the motors 20 and to vibrate the same at different speeds, while regulating battery drain.

Operation of Device

The operation of the combination massager and scarf 10 will now be described. First, the massager 14 is inserted and held in the scarf 16, as by securing the securing elements 50 on the casing 18 to the mating securing elements on side edge 48 of the opening 44 in the scarf. The connector 28 at the outer end 26 of the wire 24 is inserted in a jack 60 in the controller 30. Then, if the batteries 58 have power, or if not, and the device is connected to a vehicle's power supply by plug 36, or to a domestic power supply by plug 38, and the combination massager and scarf 10 wrapped around a person 12, as shown in FIG. 2, the controller is activated by turning knob 32. The controller may be held outside of the scarf, for example, in the hand of a user, or may be held in one of the pockets, such as 42, formed in the scarf 16. Upon rotation of the knob 32, the motors 20 will be actuated to thereby vibrate within the casing 18 and scarf 16 so as to massage the portion of the user against which the scarf and motors rest. The intensity or speed of vibration of the motors 20 is controlled by rotating the knob 32.

The scarf, with the massager therein, may be easily moved and draped over or tied to another portion of the person's body, such as the waist, so as to press the casing 18 and motors 20 against the person's back, for massaging of that portion.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A combination massager and scarf, comprising:

a massager comprised of a flexible casing having a plurality of electrical motors connected in series therein;

a scarf formed from cloth folded and secured together so as to have a pair of end pockets and a central opening therebetween;

a first plurality of securing elements held on a first edge of the central opening;

a second plurality of mating security elements held on the flexible casing whereby the flexible casing is removably secured in the central opening in the scarf by attachment of the first plurality of securing elements to the second plurality of mating securing elements; and a controller, electrically connected to the plurality of electrical motors for selective activation of the plurality of electrical motors.

2. The combination massager and scarf of claim 1, further including at least one pair of mating holding elements for holding the central opening together with the scarf wrapped around the massager.

3. The combination massager and scarf of claim 1 wherein the controller includes a rotatable knob for adjustably controlling the vibration of the plurality of electrical motors.

4. The combination massager and scarf of claim 3 wherein the controller is selectively powered by A.C. or D.C. from a variety of sources.

5. The combination massager and scarf of claim 4 wherein the controller includes a microprocessor to regulate the flow of electricity to the plurality of electrical motors.

6. The combination massager and scarf of claim 5 wherein the flexible casing has a plurality of separate pockets formed in the flexible casing for holding the plurality of electrical motors.

7. The combination massager and scarf of claim 6 wherein there are three electrical motors in three separate pockets.

8. A combination massager and scarf, comprising:

a massager having a flexible pouch with a plurality of electrical motors, connected in series, held therein;

a scarf formed from a flexible material secured together to form end pockets and a central open pocket;

the central open pocket having a first edge and a second edge around a central opening;

a first plurality of securing elements secured to the first edge;

a second plurality of mating securing elements secured to an outer surface of the flexible pouch, whereby the flexible pouch and the plurality of electrical motors are removably secured in the central open pocket by attachment of the first plurality of securing elements to the second plurality of mating securing elements; and a controller having a rotatable knob and an electrical power source connected to the plurality of electrical motors for selective vibration of the plurality of electrical motors.

9. The combination massager and scarf of claim 8, further including at least one pair of mating holding elements secured to the scarf for selectively holding the scarf wrapped around the flexible pouch.

10. The combination massager and scarf of claim 9 wherein the flexible pouch has a plurality of separate pockets, equal in number to the plurality of electrical motors to separately hold the plurality of electrical motors therein.

11. The combination massager and scarf of claim 10 wherein the controller includes a microprocessor to regulate the flow of electricity to the plurality of electrical motors to ensure that the electrical motors start and vibrate.

12. The combination massager and scarf of claim 11 wherein there are three electrical motors in three separate pockets.

13. A combination massager and scarf, comprising:

a massager comprised of a flexible pouch having an outside surface and a plurality of internal pockets;

a plurality of electrical motors held in the plurality of internal pockets;

the plurality of electrical motors being connected in series and to a controller for regulating the speed of vibration of the plurality of electrical motors;

a scarf formed from a folded piece of cloth secured together to form a pair of end pockets and a central open pocket between the pair of end pockets;

the central open pocket having first and second edges;

a first plurality of securing elements secured to one of the first and second edges;

a second plurality of mating securing elements secured to the outside surface of the flexible pouch, whereby the flexible pouch and the plurality of electrical motors are removably secured in the central open pocket by attachment of the first plurality of securing elements to the second plurality of mating securing elements;

at least one pair of mating holding elements secured to the scarf for selectively holding the scarf wrapped around the flexible pouch; and the controller including a rotatable control knob and an electrical power source connected between a microprocessor and the plurality of electrical motors to regulate the flow of electricity to the plurality of electrical motors to ensure that the electrical motors start and vibrate.

14. The combination massager and scarf of claim 13 wherein there are three electrical motors in three separate internal pockets.

* * * * *